United States Patent [19]

Henderson

[11] 4,004,567

[45] Jan. 25, 1977

[54] APPARATUS AND METHOD FOR AUTOMATICALLY PROPELLING GAME BALLS FOR PRACTICE

[76] Inventor: Michael L. Henderson, 3505 E. John, Seattle, Wash. 98102

[22] Filed: June 6, 1975

[21] Appl. No.: 584,619

[52] U.S. Cl. ..... 124/61; 124/16; 124/41 R; 124/50; 124/32; 251/48; 124/1

[51] Int. Cl.[2] ..... F41B 11/00

[58] Field of Search ..... 124/1, 26, 36, 41 R, 124/50, 32, 16, 61; 273/96 R

[56] References Cited

UNITED STATES PATENTS

| | | | |
|---|---|---|---|
| 1,156,047 | 10/1915 | Behrend | 124/1 |
| 2,700,379 | 1/1955 | Brigati | 124/41 R X |
| 3,111,314 | 11/1963 | Topper | 124/36 X |

FOREIGN PATENTS OR APPLICATIONS

| | | | |
|---|---|---|---|
| 923,628 | 4/1963 | United Kingdom | 124/1 |

*Primary Examiner*—Richard C. Pinkham
*Assistant Examiner*—William R. Browne
*Attorney, Agent, or Firm*—Christensen, O'Connor, Garrison & Havelka

[57] ABSTRACT

A compact pneumatically powered apparatus for automatically propelling game balls, especially tennis balls and the like intended to be stroked by a hand held racket or other implement, for training players in the proper return of the simulated ball action. Each ball is ejected from the apparatus with a combination of forward or straight-line acceleration together with a predetermined amount of ball spin to closely approximate the intentional spin placed on tennis balls when stroked obliquely by a tennis racket. This is achieved in the apparatus by a mechanism for flexing an elongate pliable member, such as a flexible belt, between an initial slackened looped condition and a straightened tensioned condition. The tennis balls are successively fed into a launching position contacting a surface portion of the slackened, looped belt that faces generally forwardly toward the direction of ball propulsion and is initially rearwardly of the final orientation of the tensioned belt. After positioning the ball, a tensioning arm connected to one end of the slackened belt is actuated to apply an abrupt tensioning force to the belt. The belt tensioning arm is powered by a pneumatic cylinder. The device is portable and is powered by reusable pressurized air storage tanks which may be hand carried onto the court, utilized indoors or outdoors and operated where electrical power is unavailable.

16 Claims, 10 Drawing Figures

Fig. 2
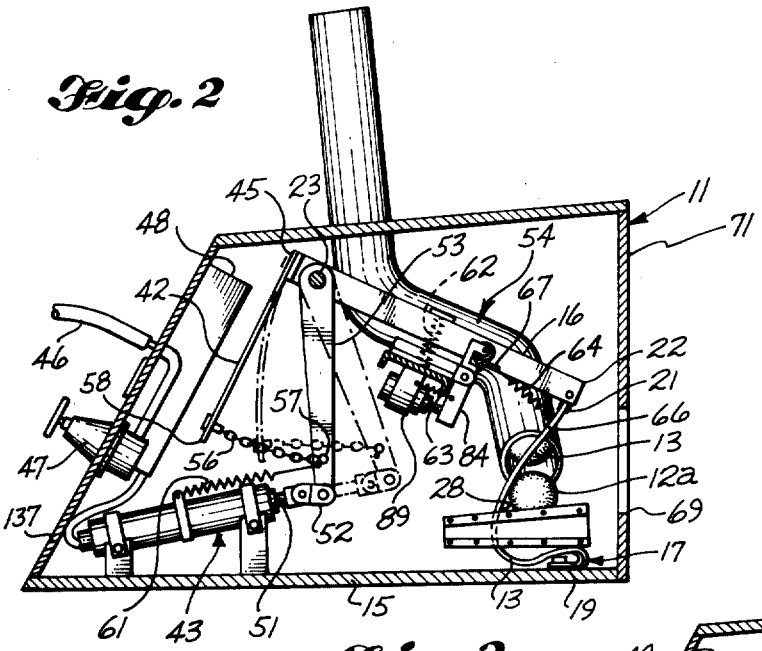
Fig. 3
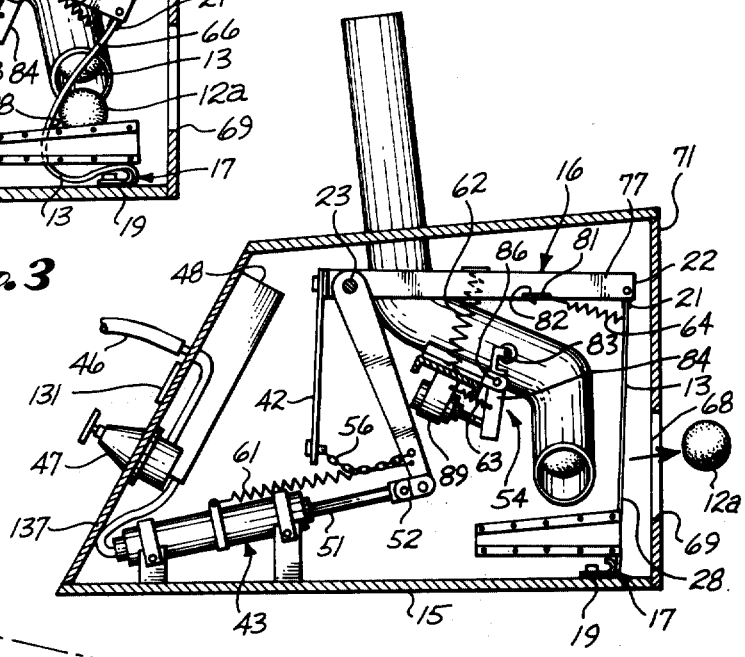
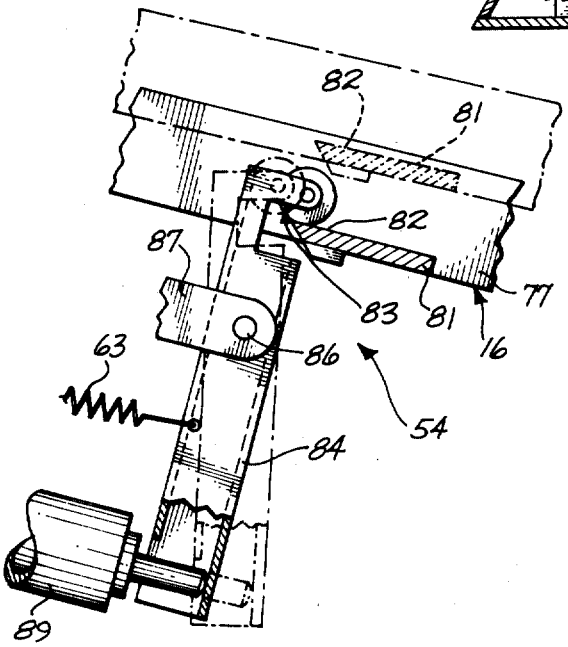
Fig. 4
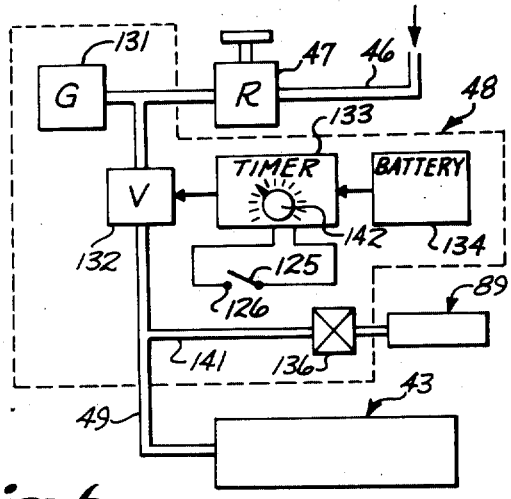
Fig. 6

Fig. 7
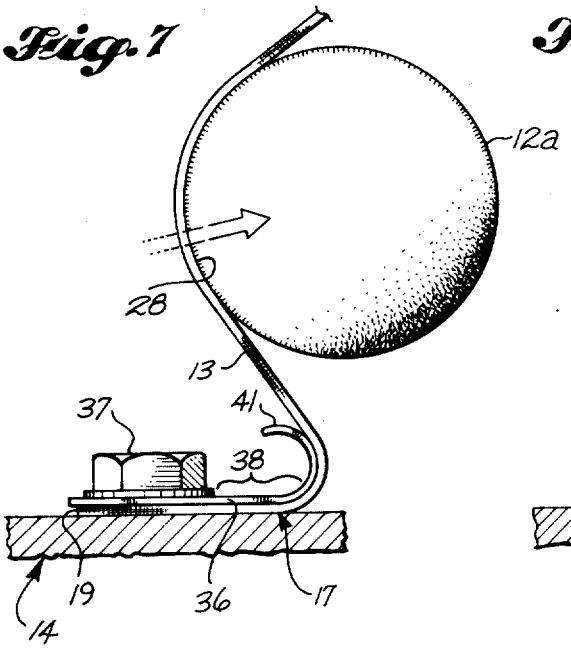
Fig. 8
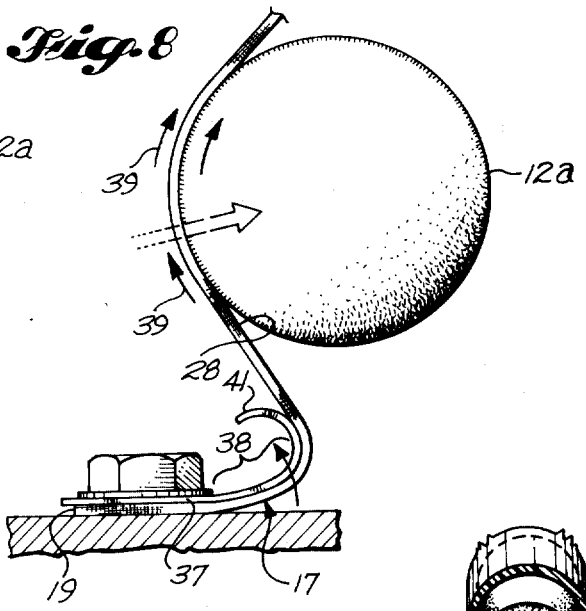
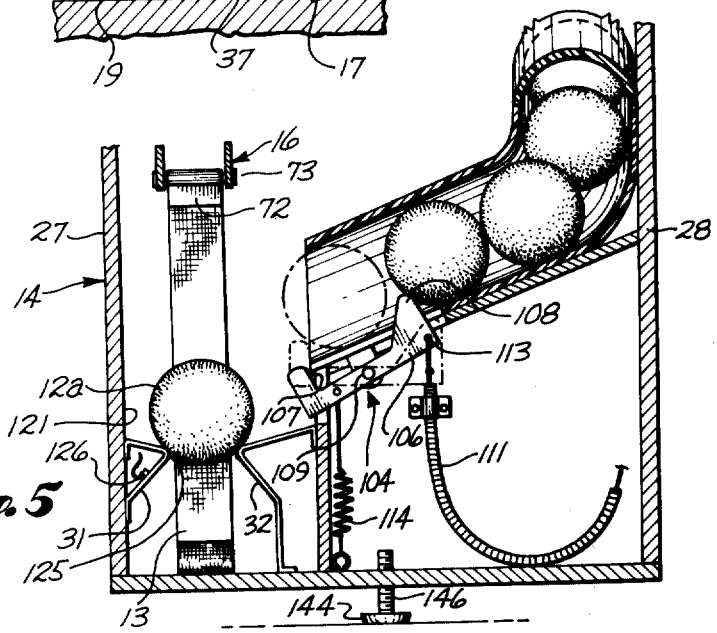
Fig. 5
Fig. 9
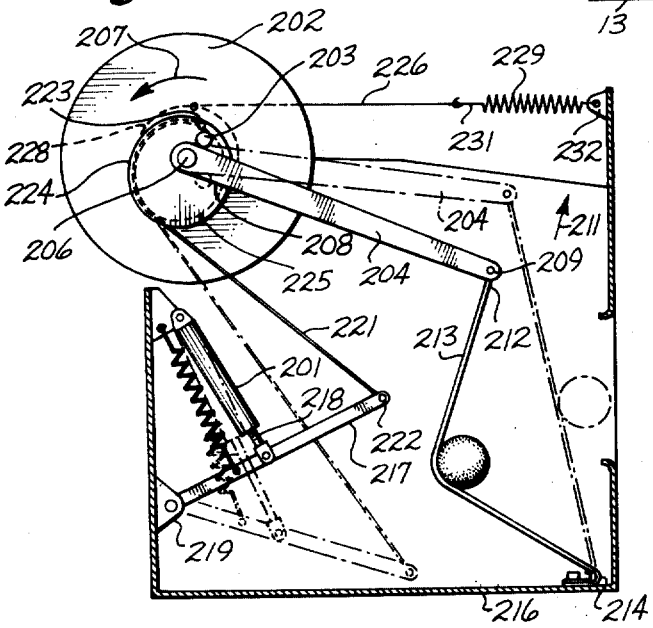
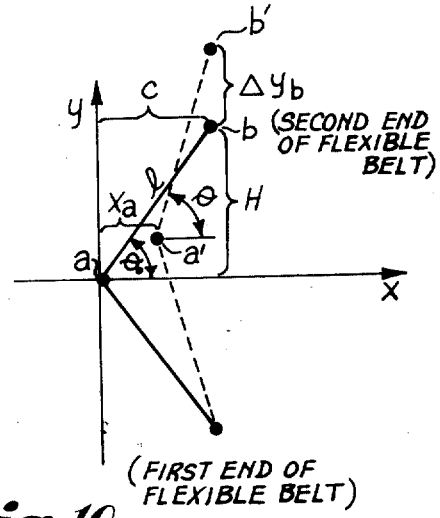
Fig. 10

APPARATUS AND METHOD FOR AUTOMATICALLY PROPELLING GAME BALLS FOR PRACTICE

BACKGROUND OF THE INVENTION

The present invention pertains to method and apparatus for mechanically propelling game balls to simulate the action of such a ball when stroked with a hand held implement, such as occurs in stroking a tennis ball with a tennis racket.

The use of mechanical methods and devices for automatically throwing or propelling tennis balls for practice and in the training of students and players of tennis is in general known. For example, machines are available which may be positioned on one side of a tennis court for sequentially ejecting a series of tennis balls carried in a refillable hopper, in which the trajectory of each propelled ball passes over the tennis net onto the opposing side of the court where an awaiting player practices his return stroke in response to the artificially delivered ball. The trajectory of the balls can be selected and is, of course, repetitive, allowing the player to concentrate on particular return strokes.

Although it is thus seen that devices of this type have an established utility, the available mechanisms are relatively large and bulky and thus are not readily portable in the sense that they can be hand carried by a single person onto a tennis court. Moreover, the devices are expensive, beyond the financial resources of many tennis instructors, and beyond the pocket book of most recreational and amatuer tennis students and players. Additionally, because of the mechanical operating characteristics of these known devices, they are typically subject to substantial mechanical vibration and component wear resulting in a shortened useful life and frequent breakdown of the apparatus. Many of these devices also require electrical power for their operation, thus limiting their usefulness inasmuch as many tennis courts do not have the necessary electrical facility. Other devices, again because of their mechanical operating characteristics, are powered by small gasoline engines which emit dangerous exhaust fumes precluding their use on indoor courts.

Another disadvantage of many existing tennis ball throwing mechanisms is their inability to realistically simulate the action of a racket stroked tennis ball. For ground strokes, which is the most frequently used stroke during a tennis game, the ball is usually struck by the racket in a manner which imparts either a top spin or a bottom spin to the propelled ball. Most often, a top spin is delivered to the ball to cause it to drop more quickly on the opposing court for controlled placement. Although devices having the ability to impart spin to the tennis ball are, in general, known, such devices are either unable to realistically simulate a ball spin developed by a tennis racket or lack some other important, desirable feature such as reasonable price, reliability or portablility, simplicity of operation, and adjustability in speed of ball delivery and ball spin.

SUMMARY OF THE EMBODIMENTS OF THE INVENTION DISCLOSED HEREIN

Accordingly, it is an object of the present invention to provide an improved method and apparatus for propelling game balls, especially of the type which are intended to be stroked with a hand held instrument, such as tennis balls by a tennis racket, and which overcomes one or more of the above noted disadvantages of existing systems.

Briefly, an apparatus and method utilizing a flexible or pliable elongate member or belt is provided in which the belt is forcefully flexed between an initial, ball receiving, slackened looped or curved condition and a straightened, tensioned condition causing outward acceleration of the ball. In its initial configuration, the pliable belt is mounted with longitudinally spaced apart portions thereon in a relatively proximate relationship causing the belt to assume a slackened, looped configuration between such belt portions defining a ball receiving surface of the belt that faces generally forwardly toward the direction of intended ball trajectory and is displaced rearwardly of the orientation assumed by the belt when tensioned. The tennis ball or other game ball is initially positioned against this belt surface. To propel the ball, an abrupt tensioning force is applied to the belt by means displacing the initially proximate belt portions toward a relatively spaced apart distal relationship causing the belt to assume a straightened tensioned condition which propels the ball into a trajectory generally defined by the plane of flexure of the belt between its looped and straightened conditions. Because of the geometrical relationship between the movement of the belt ends and the displacement of the body of the belt at the point of contact with the ball, most of the energy required to tension the belt is imparted or transferred to the ball such that when the ball leaves the belt, the mechanism has been exhausted of substantially all of the energy and motion needed to tension the belt. Only a minimal amount of residual energy remains in the machine, thus minimizing its vibration, noise and component wear.

To impart spin to the game ball, the longitudinally spaced portions are differentially displaced with respect to the initial ball position, such that a certain amount of longitudinal belt movement occurs at the ball-to-belt contact point or interface. By reason of the frictional engagement between the ball and belt, this longitudinal belt displacement produces rotation of the ball simultaneously with its outward propulsion from the mechanism. The differential tensioning or displacement applied to the belt is accomplished in the embodiment of the invention described herein by anchoring one end portion of the belt to the housing or support for the apparatus and driving the other end portion of the belt by means of a pivoted arm which when actuated abruptly tensions the belt. Actuation of the tensioning arm is achieved in one embodiment disclosed herein by a spring which is connected to the arm and which is flexed to a loaded condition by a pneumatic cylinder. When the spring is released, the tensioning arm drives the belt to its tensioned condition effecting each ball ejectment. In another embodiment, the tensioning arm is driven by the kinetic energy stored in a flywheel which is first rotatably accelerated by a pneumatic cylinder suitably linked to the flywheel.

The entire apparatus, may be mounted in a compact housing which may be hand carried by one person onto the tennis court. In the embodiments disclosed herein, the belt is mounted for flexure in a vertical plane, with a lower belt end portion anchored to the housing of the mechanism and an upper end portion attached to the tensioning arm such that the length of the belt is generally perpendicular to the court surface when in its straightened tensioned condition. As the belt is driven from its slackened condition to its tensioned state, there is an upward motion of the belt at the point of contact with the ball which causes the ball to rotate in a top spin, thus simulating one of the more frequent tennis racket strokes. However, the belt may in general be arranged for flexure in any desired plane to produce top spin, bottom spin, side spin or spin at any intermediate angular orientation. Furthermore, the belt may be tensioned by displacing both end portions, so long as there is a differential displacement with respect to the initial ball position, to product the desired spin producing longitudinal motion of the belt at its interface with the ball.

These and further features, objects and various advantages of the apparatus and method for automatically propelling game balls in accordance with the present invention will become apparent to those skilled in the art from a consideration of the following detailed description and appended drawings of the particular embodiments disclosed herein.

BRIEF DESCRIPTION OF THE DRAWINGS

FIG. 2 is a side plan view of the apparatus shown in FIG. 1 with a side panel of the housing deleted to reveal the orientation of the internal components prior to the ejectment of the tennis ball.

FIG. 3 is a side plan view similar to FIG. 2, illustrating the position of the internal mechanisms immediately after a tennis ball has been ejected.

FIG. 4 is a detailed view of the pneumatically operated latch mechanism for initially holding and thereafter releasing the spring loaded tensioning arm for driving the flexible belt to a tensioned condition.

FIG. 5 is a front plan view of the apparatus shown in FIG. 1, with the front panel of the housing deleted to expose the interior components of the mechanism.

FIG. 6 is a diagrammatic view of the electro-pneumatic control system utilized to automatically operate the apparatus for sequentially ejecting a plurality of tennis balls at controlled time intervals.

FIG. 7 is a partial, enlarged view of the belt-to-ball interface and illustrates a flexible mounting bracket anchoring the lower end of the belt to the apparatus housing for providing a predetermined amount of top spin to the propelled ball.

FIG. 8 is a partial enlarged view similar to FIG. 7 illustrating the changed orientation of the various components at a more advanced time during the tensioning of the belt and acceleration of the ball.

FIG. 9 is an alternative preferred embodiment of the method and apparatus in accordance with the present invention in which the energy for driving the tensioning arm is stored in a rotating flywheel.

FIG. 10 is a graph, diagrammatically illustrating the geometry of the belt as it is driven from the slackened looped condition to the straightened tensioned condition.

DESCRIPTION OF THE PREFERRED EMBODIMENTS

Figure 1:
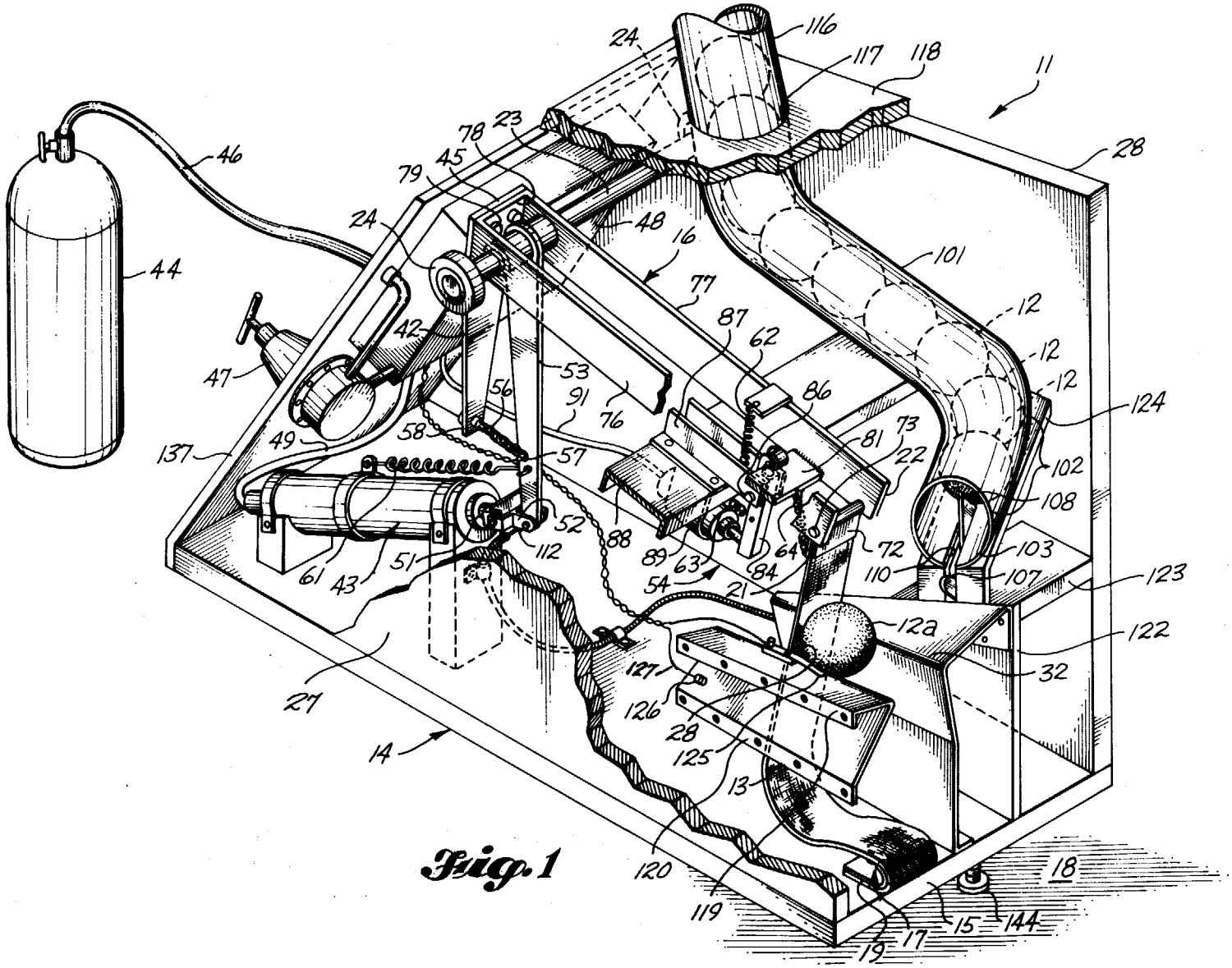
FIG. 1 is a perspective view of an apparatus for automatically propelling game balls constructed in accordance with the present invention, and in which the housing therefor is partially cut away to reveal the internally mounted components of the mechanism.

One particular embodiment of the method and apparatus in accordance with the present invention is illustrated in FIGS. 1 through 6, in which a compact, portable, pneumatically powered ball propelling unit 11 is provided for receiving, temporarily holding and sequentially ejecting a plurality of tennis balls 12. Although the principles of the present invention may be utilized in general for propelling game balls of any of a wide variety of types, the mechanisms and methods particularly disclosed herein are intended for throwing or propelling game balls of the type normally stroked with a hand held implement, such as represented by the stroking of a tennis ball with a tennis racket. In this environment, unit 11 provides a training or practice aid for mechanically delivering a time spaced sequence of tennis balls 12 at a speed, trajectory and spin simulating a properly stroked tennis ball. Thus in a practice or training session, unit 11 may be disposed on one side of a tennis court for delivering balls 12 to a player or student situated on the opposing side of the net, wherein the mechanical ball delivery provides for a consistency of speed and placement allowing the receiving player to concentrate on practicing a particular return stroke.

In accordance with the method and apparatus of the present invention, unit 11 includes an elongate, pliable member, here embodied by a flexible web or belt 13 connected at a first portion, here adjacent one end of the belt, to a support means provided by housing 14 and to an arm 16 at a second portion longitudinally spaced along the belt from the first portion and here being adjacent the opposite end of the belt. Arm 16 is pivoted within the housing for abruptly tensioning belt 13 from an initial, looped, slackened condition as it is shown in FIG. 1 to simultaneously outwardly propel and impart spin to one of the tennis balls disposed for launching, in this instance ball 12*a*. For this purpose, elongate belt 13 is disposed generally vertical when tensioned and has a lower one of its end portions mounted to a bottom wall 15 of housing 14 by a mounting bracket assembly 17, wherein bottom wall 15 of the unit is disposed substantially parallel to the surface 18 of the court or other practice ground. For reasons dicussed more fully hereinafter, end 19 of belt 13 need not be fixedly anchored to housing 14, and indeed assembly 17 may provide a certain amount of resilient flexibility or give in response to an abrupt tensioning of the belt. A second end portion, in this instance the upper end 21, of belt 13 is fastened adjacent an end 22 of arm 16, and arm 16 is pivoted on a shaft 23 about an axis extending at right angles to the length of belt 13. Accordingly, arm 16 as best shown in FIGS. 2 and 3 is pivotally mounted on shaft 23 which in turn is carried in bearings 24 by opposed upstanding sidewalls 26 and 27 of housing 14 for rotational movement between an unactuated position which as shown in FIGS. 1 and 2 disposes the opposed ends 19 and 21 of belt 13 in a relatively proximate relationship, and an actuated position as shown in FIG. 3 in which arm 16 is rotated at end 22 upwardly to force the belt end 21 upwardly into a relatively distal position with respect to the lower end 19 of the belt.

This actuation of arm 16 flexes belt 13 from its initial, slackened, looped condition shown in FIGS. 1 and 2, to a tensioned, straight condition as shown in FIG. 3. By abruptly or rapidly articulating arm 16 in this manner, belt 13 is snapped or flexed briskly between the looped configuration and the straightened tensioned configuration propelling ball 12*a* outwardly at a speed which may be selected to approximate a tennis ball stroked by a racket.

To hurl the ball in this manner, the belt 13 is looped or curved rearwardly away from the intended direction of ejectment and the ball is initially positioned at rest against a surface 28 of the slackened, looped belt which faces generally forwardly toward the direction of ball propulsion and which lies rearwardly of the orientation of the belt when tensioned. The belt is thus disposed for being flexed to its tensioned condition in the general direction and within the plane of the intended ball trajectory. This initial positioning of each of the tennis balls is provided by a ball receiving and positioning means, here in the form of a pair of spaced apart substantially parallel ball receiving and guiding rails 31 and 32 carried by housing 14 and mounted parallel to and on opposite sides of the general plane of flexure of the belt and separated by a distance less than the diameter of the balls 12 and equal to or greater than the width of the belt.

To simultaneously impart spin to each of the tennis balls, the opposite ends 19 and 21 of belt 13 are differentially accelerated or displaced during the tensioning of the belt with respect to the initial, at-rest position of the tennis ball. In the particular embodiment disclosed herein, the fastening of lower belt end 19 to the support means provided by housing 14, while the opposite and upper end is accelerated by end 22 of arm 16, represents one particular case of a differential displacement applied to the opposite belt ends. In general, any differential displacement, including the particular case illustrated here, will produce a certain amount of longitudinal motion of the belt at the ball-to-belt interface during the propulsion phase. This is best seen by comparing FIGS. 2 and 3, in which it will be noted that the original point of contact or interface between ball 12*a* and surface 28 of belt 13 will undergo an upward displacement away from end 19 and toward the ultimate disposition of end 21 as the belt is flexed between its slackened and tensioned condition. With the ball 12*a* initially engaged with some longitudinally intermediate point or portion of belt surface 28, a spin will be imparted to the ball as such intermediate point or portion undergoes longitudinal movement toward the end of the belt receiving the greater amount of displacement with respect to the initial at-rest ball position. With the tennis ball firmly in contact with the belt by reason of the acceleration force applied to the inertia of the ball, substantial ball to belt frictional engagement will force the ball to rotate in response to the above mentioned longitudinal belt movement. It is this rotation of the belt simultaneously with its outward propulsion which causes the desired ball spin to be produced.

The amount of ball spin may be selected and controlled by a number of variables, including the amount of surface friction exhibited by the surface 28, by the exterior surface of the game ball and by the relative amounts of differential displacement of the longitudinally opposed ends of the belt. With respect to the characteristics of the belt surface, it has been found that the texture of a woven fabric belt, such as an automobile seat belt, provides a suitable amount of frictional engagement with a tennis ball for imparting an appropriate amount of spin to the tennis ball in the apparatus disclosed herein. Similarly, a selective amount of differential displacement at the end of the belt may be utilized to provide an appropriate ball spin. Thus, it is not necessary to fixedly anchor or mount one end of the belt to the housing support as is done in the presently illustrated embodiment, inasmuch as both ends of the flexible belt may be movably mounted so long as one end receives a different amount of displacement relative to the initial position of the ball during flexure of the belt to its tensioned condition.

A further manner in which the degree of ball spin may be controlled is provided in the presently illustrated embodiment by a relatively simple, yet effective mounting bracket assembly 17 for securing the lower end 19 of belt 13 to housing 14. The structure and operation of assembly 17 is best illustrated in FIGS. 7 and 8, in which assembly 17 includes resilient means for initially holding belt 13 in a foreshortened condition until sufficient tension has been developed in the belt by the belt-to-ball acceleration force to cause the resilient means to yield an additional length of belt to the upwardly directed tensioning forces. The timed release of the additional belt length causes an enhanced or increased longitudinal motion of the belt at the ball to belt interface, thereby increasing the amount of spin imparted to the ball.

In this particular embodiment, such resilient means is provided by a resiliently flexible plate-like member 36 overlying a longitudinal section of belt 13 adjacent end 19 and secured to bottom wall 15 of housing 14 by a suitable fastener 37 which may also, as in the present embodiment, anchor end 19 of belt 13 to the housing wall 15.

A flexible portion 38 of member 36 extends outwardly from beneath fastener 37 in overlying relationship with respect to a longitudinal section of belt 13 adjacent the anchored end 19 of the belt so as to foreshorten belt 13 by holding this longitudinal section thereof in a plane which is substantially at right angles to the plane of the belt in its tensioned condition. In response to sufficient amount of tension to cause member 36 to yield, portion 38 is flexed by the forces on belt 13 upwardly toward the tensioning force applied to the opposite belt end, allowing the belt to lengthen as illustrated in FIG. 8 increasing the amount of longitudinal belt motion as indicated by arrows 39 at the ball to belt interface. A rounded or contoured end 41 of member 36 adjacent flexible portion 38 may be provided for guiding the belt between the direction of applied tension and the plane of anchorment of the belt at right angles thereto. The amount of additional spin created by the provision of resilient member 36 can be selected by changing the degree of stiffness of the member and the dimension of flexible portion 38 along the length of belt 13. It will be observed, that such a resilient means is not always needed, as sufficient spin may be developed in many cases by a belt terminated at the lower end by an abrupt, nonyielding connection to the support.

The means for tensioning belt 13 includes in addition to elongate arm 16, a spring means, here in the form of leaf or bow spring member 42, to provide as an intermediate energy storage device for driving arm 16 in response to a pneumatic cylinder and piston assembly 43. More particularly, the combination of bow spring member 42 and pneumatic cylinder and piston assembly 43 serves to load the spring member in response to a source of stored, pressurized air available from a refillable, portable air tank 44 connected to unit 11 by means of an air hose 46. Although in some cases the pneumatic cylinder assembly may be employed directly to tension belt 13 either with or without the assistance of a tensioning arm similar to arm 16, in the illustrated embodiment, here the power source in the form of pressurized air is used to load the bow spring member 42 through the slower acting cylinder and piston assembly 43, to permit a rapid or abrupt actuation of arm 16 and belt 13 when the spring is released.

For this purpose, assembly 43 is connected to receive pressurized air from tank 44 over a connecting air hose 46, a pressure regulator 47, a battery operated electro-pneumatic controller 48 and an interconnecting air hose 49. As described more fully herein, controller 48 serves to apply air pressure to cylinder assembly 43 in preparation for each ball ejectment. Responsively, a piston 51 is driven outwardly to an extended position as indicated by the dotted lines in FIG. 2 and the solid lines in FIG. 3. A pivotal connection 52 joins the end of piston 51 distal from assembly 43 to an end of an elongate, rigid linkage member 53, the opposite end of which is mounted on shaft 23 for free rotation relative to the pivoted tensioning arm 16.

Bow spring member 42 as shown in FIGS. 1, 2 and 3 is an elongate member having one of its ends rigidly connected to arm 16 adjacent the pivotal mounting provided by shaft 23. In this instance, for compactness, member 42 is mounted substantially at a right angle with respect to arm 16, and with the opposite end of member 42 disposed generally adjacent assembly 43 and piston 51 thereof. With arm 16 held in its unactuated condition of rotation as shown in FIG. 2 by means of a pneumatically operated latch assembly 54, spring member 42 is loaded to an elastically deformed state as shown by the dotted lines in FIG. 2 by a flexible linkage, here in the form of a chain 56, connecting the end of member 42 distal from arm 16 to rigid linkage member 53 at a point 57 intermediate connection 52 and its pivotal or rotational mounting to shaft 23. With the rigid connection of end 45 of member 42 to arm 16 adjacent shaft 23 and the flexible coupling of chain 56 between intermediate point 57 on member 53 and end 58 of member 42, the bow spring is deflected in a direction which tends to rotate arm 16 at end 22 away from, and in this instance upwardly of, the lowered anchored end 19 of belt 13.

As soon as the loading of bow spring member 42 has been completed, controller 48 serves to energize pneumatically operated latch 54 to release arm 16 which responsively flies upwardly at end 22 under the recoiling force of member 42, pivoting member 16 to its actuated position as shown in FIG. 3 with belt 13 abruptly snapped to a tensioned condition. As will be described more fully hereinafter, this operation is repeated for each tennis ball received on rails 31 and 32 for propulsion by belt 13. To restore the initial conditions of assembly 43, arm 16 and latch assembly 54, lightweight return springs are provided as indicated at 61, 62 and 63 respectively. These return springs are selected to provide just enough force in their extended conditions to return the various components to their initial positions as shown in FIG. 1 and without significantly restraining the substantially larger actuating forces applied during loading and recoiling of spring member 42.

Also, for reliability, a still further lightweight spring 64 may be provided connecting belt 13 at an intermediate longitudinal position 66 thereon to an intermediate point 67 on arm 16 adjacent ends 21 and 22 of the belt and arm respectively, for biasing the natural loop or curved configuration of belt 13 in its slackened condition inwardly of unit 11 and rearwardly of the direction of discharge of the tennis ball 12*a*. In this instance, the direction of discharge is indicated by arrow 68 of FIG. 3, propelling tennis ball 12*a* through a ball discharge aperture 69 formed in a front panel or wall 71 of housing 14. To enhance the biasing effect of spring 64 and to minimize wear at the connection of end 21 of belt 13 to end 22 of arm 16, a gripping clasp 72 spanning the width of belt 13 and firmly secured to the belt end 21 is pivotally mounted to arm 16 adjacent end 22 about an axis 73 extending transversely to arm 16 and to belt 13.

Arm 16 is, in this embodiment, formed by a pair of spaced apart parallel bars 76 and 77 rotatably mounted on shaft 23 and having a transversely extending interconnecting end portion 78 to which end 45 of spring member 42 is secured by suitable fastening means such as rivet or bolt fasteners 79, and a transversely extending interconnecting member 81 mounted adjacent arm end 22 and including a latch engaging portion 82 for cooperating with a roller assisted latch 83 of pneumatically operated latch assembly 54. Latch 83 is provided adjacent one end of an elongate member 84 pivotally mounted about an axis 86 on a mounting bracket 87 fixedly carried by an elongate structural support member mounted between sidewalls 27 of housing 14 transversely underlying arm 16.

Member 88 additionally carries a relatively small pneumatic cylinder and piston assembly 89 for selectively pivoting member 84 about its axis 86 to operate the latch mechanism between a latched condition in which latch 83 is engaged with latch receiving portion 82 of member 81 and an unlatched condition in which member 84 is pivoted by assembly 89 to disengage latch 83 from member 81 and release arm 16 to fly upwardly under the recoiling force of spring member 42. Pneumatic cylinder and piston assembly 89 is actuated by an appropriately timed increase in air pressure received over an interconnecting air line from electro-pneumatic controller 48.

To provide means for holding a plurality of tennis balls 12 and feeding such balls one at a time into position on the spaced rails 31 and 32 for ejectment by belt 13, a gravity feed ball chute 101 of tubular configuration is provided having a downwardly inclined lower section 102 terminating in an open end 103 adjacent rails 31 and 32 and to the front of belt 13 and surface 28 thereof when in the slackened, looped condition prior to actuation of tensioning arm 16. The tubular chute is dimensioned so as to accommodate the tennis balls 12 in single file and an automatically operated release-catch mechanism 104 is mounted as shown in FIG. 5 to extend into the tubular chute adjacent opening 103 to release each of tennis balls 12 one at a time onto rails 31 and 32.

More particularly mechanism 104 is here provided by a generally elongated member 106 having a pair of spaced apart integral ball stop portions 107 and 108 extending generally tranversely to the length of member 106 in a common direction therefrom. Member 106 is pivotally mounted about an axis 109 extending substantially at right angles to the axis of tubular chute portion 102 adjacent a lowermost wall portion thereof to dispose the length of member 106 substantially parallel to the axis of tubular chute portion 102 with transverse ball stop portions 107 and 108 being rotatable within a longitudinally extending slot 110 formed in tubular portion 102 adjacent opening 103. Thus, member 106 is operable through a full cycle of limited rotation as indicated by the solid and dotted line positions of FIG. 5 in which stop portion 108 is initially disposed to obstruct the gravity feed of tennis balls adjacent opening 103 of chute 101 with a tennis bali 12*a* already in position for being ejected by belt 13. As the main spring member 42 for operating tensioning arm 16 is loaded by cylinder assembly 43, a draw wire linkage 111 rotates member 106 in response to the outward extension of piston 51 of cylinder assembly 43, and for this purpose one end of linkage 111 is coupled to connection 52 at 112 as shown in FIG. 1 so that the linkage is responsive to the outward extension of piston 51 upon actuation of cylinder assembly 43, while the opposite end of linkage 111 is connected at 113 to an end of elongate member 106 adjacent the upstream ball stop portion 108. Thus, linkage 111 causes member 106 to be rotated between the position shown by the solid lines in FIG. 5 through the dotted line position also shown in FIG. 5 and back to the solid line position in response to a full cycle of extension and retraction of the piston 51 of assembly 43. This allows a tennis ball to be trapped between stops 107 and 108 during the cyclic rotation of member 106 thereby individually feeding one ball at a time into position on rails 31 and 32 during the loading of spring member 42 and thus prior to each actuation of tensioning arm 16. A spring 114 serves to bias member 106 into the position of rotation in which the upstream stop portion 108 obstructs the gravity feed of the balls.

For storing a sufficient plurality of tennis balls suitable for a practice session, tubular chute 101 may be upwardly extended at an incline to an upstanding, gravity feed, tubular holder 116 rising through an opening 117 in a top wall 118 of housing 14. Additional ball holding capacity may be provided by attaching a suitable ball hopper to holder 116, or in the alternative replacing holder 116 with any of a wide variety of known types of ball hoppers.

To feed each of the tennis balls against surface portion 28 of belt 13 in its slackened, looped condition, rails 31 and 32 are here provided with a rearwardly downwardly inclination or slope such that as the balls are dropped onto the rails, they roll downwardly into contact with surface 28 of the belt. Rail 31 may be formed of sheet metal bent to form a horizontally oriented "V" configuration with the legs 119 and 120 thereof secured to an inside surface 121 of sidewall 27. Rail 32 may be similarly formed of sheet metal contoured to be mounted between a bottom wall 15 of housing 14 and an upstanding partition 122 supported in turn by a horizontally extending partition 123 within housing 14, wherein such partitions also serve as an internal support for an inclined ramp member 124 for chute section 102.

To prevent the unit from continuing to snap belt 13 to a tensioned condition after exhausting the supply of balls within chute 101, a sensor means is provided on rail 31 in the form of an electro-mechanical contact switch which is in this instance closed under the weight of a tennis ball. Such a switch may be provided as in the present embodiment by an elongate resilient electrically conducting member 125 deflected under the weight of tennis ball 12*a* to cause contact with a stationary, electrical contact here provided by rail 31. One end of deflectable elongate member 125 is mounted on an insulator 130 carried by rail 31 which is itself made of an electrically conductive metal so that the switch is closed by deflecting member 125 into electrical contact with the rail surface. Electrical wire leads 127 are individually connected to rail 31 at terminal 126 and to member 125 and are extended to electro-pneumatic controller 48. In this manner, controller 48 receives a signal sensing the presence of each of the tennis balls as they are dropped onto positioning rails 31 and 32.

Electro-pneumatic controller 48 serves to actuate the pneumatic assemblies 43 and 89 for driving tensioning arm 16 at suitably timed intervals for sequentially delivering the plurality of tennis balls 12 with a sufficient lapse of time to allow the player time to respond to each delivered ball. More particularly, the controller is diagrammatically illustrated in FIG. 6 and includes a pressure gauge 131, a solenoid actuated pneumatic valve 132, a battery operated electrical timer 133, battery 134 and an air flow restrictor 136. The output of timer 133 is connected to and for operating solenoid valve 132 at repetitive intervals unless the aforementioned ball presence sensor provided by the switch formed between members 125 and rail 31 signal an absence of a ball on the positioning rails.

In operation, variable regulator 47, which is mounted on a front control panel 137 of housing 14, may be manually adjusted to regulate the maximum amount of air pressure applied through valve 132 to pneumatic cylinder and piston assembly 43 for loading the bow spring member 42. The pressure permitted by regulator 47 may be monitored on gauge 131, mounted on front control panel 137, with the greater levels of air pressure providing maximum deformation of spring member 42 by piston 51, thus maximizing the tensioning force applied to belt 13 and increasing the speed of delivery of the tennis balls. Lower ball speeds may be produced by reducing the pressure at regulator 47. It has been found that the mechanism is capable of delivering the tennis balls consistently at tournament speeds, using an air tank 44, which may be replenished by the air pressure available at most gasoline service stations.

Timer 133 serves to periodically operate solenoid valve 132 so long as the tennis ball sensor detects the presence of a ball on rails 31 and 32. Each time valve 132 is operated by timer 133, piston 51 of cylinder assembly 43 is extended to flex the bow spring member 42 to a loaded condition. It will be observed, that the opening of valve 132 simultaneously applies air pressure over a connecting line 141 terminated by the latch operating cylinder assembly 89. However, a pressure restrictor valve 136 is disposed in the air line in advance of pneumatic cylinder assembly 89 so as to cause a delayed actuation thereof allowing assembly 43 to fully load spring member 42. Thus, pneumatic cylinder 89 is operated to release latch assembly 54 only after the main bow spring for arm 16 has been fully flexed by pneumatic cylinder assembly 43.

Subsequent to each energization of assemblies 43 and 89, valve 132 is closed again to allow for the retraction of the pneumatic cylinder pistons. In this respect, return springs 61 and 63 associated with assemblies 43 and 89, respectively, assist in the returning of the cylinder pistons to their initial retracted condition.

Timer 133 repetitively operates valve 132 to cause the foregoing sequence of operation to be repeated at time intervals determined by the setting of a manual timer control 142, which may be mounted for manual access on front panel 137 of the unit housing. Accordingly, the lapse of time between each ball delivery may be adjusted to suit the pace of the individual player or student.

In order to adjust the elevation of the trajectory for each of the propelled tennis balls, an adjustable front foot 144 having a threaded shank 146 matingly mounted in an internally threaded bore provided in the bottom wall 15 of housing 14 and extending perpendicularly thereto adjacent the front wall 71 of the unit, provides a means for adjusting the angle of the ball trajectory. In general, the mounting of belt 13 and arm 16 will be selected to cause the balls to be propelled in a trajectory closely simulating a tennis ball ground stroke when the unit 11 is merely placed on the court surface. However, adjustable foot 144 serves to provide limited adjustment of this trajectory.

Although a spring member is utilized in the embodiment of FIGS. 1 through 5 to store the energy for actuating the tensioning arm connected to the flexible band, other means may be utilized to snap the belt to a tension condition. With reference to FIG. 9, an alternative energy storage device is diagrammatically illustrated for use in actuating the tensioning arm between the slackened belt condition and the tensioned belt condition. In this case, the energy provided by a pneumatic cylinder and piston assembly 201 is utilized to rotatably accelerate a flywheel 202 which thereupon provides a source of kinetic energy which may be transferred to and for actuating the tensioning arm.

More particularly, flywheel 202 is provided with an eccentrically disposed drive or camming pin 203 mounted for rotation with the flywheel to engage an elongate tensioning arm 204 rotatably mounted about an axis 206 concentric with the rotational axis of flywheel 202. When flywheel 202 is rotated in the direction indicated by arrow 207, the eccentricity of camming pin 203 engages a longitudinal edge 208 of arm 204 at a point offset from the axis 206 of rotation, causing the arm 204 to be rapidly accelerated at one end 209 in a direction 211. End 209 of the arm 204 is connected to an upper end 212 of a flexible elongate member or belt 213 with the opposite lower belt end 214 anchored to a support means provided by a housing 216. Thus, the direction of acceleration of end 209 of arm 204 is selected to apply an abrupt tensioning force to belt 213, in a manner similar to the tensioning force applied to belt 13 by arm 16 in the above described embodiment.

The acceleration of flywheel 202 is effected by articulating a pivoted arm 217 by means of the piston 218 of pneumatic cylinder assembly 201 between the solid and dotted line positions as shown in FIG. 9. With a first end 219 of arm 217 pivoted as shown to housing 216, and an accelerating cord 221 connected to an opposite end 222 of arm 217, a relatively rapid pull force is applied to cord 221. An accelerating pulley 224 eccentrically formed on or mounted to flywheel 202 coacts with cord 221 to accelerate the flywheel, initially with a relative high torque lower speed, and thereafter with increasing rotational speed as the eccentricity of the pulley disposes cord 221 at a continuously decreasing offset with respect to the flywheel axis. An end of cord 221 may be anchored to a point 223 within groove 225 of eccentric pulley 224.

In this manner, pneumatically actuated means are provided for accelerating flywheel 202 to develop sufficient kinetic energy therein for actuating tensioning arm 204 between its unactuated and actuated positions. A means may be provided for recoiling flywheel 202 after each ball ejectment, wherein such means is here provided by a recoiling cord 226 secured to flywheel 202 at an intermediate radial point 227 adjacent an axially extending concentrically mounted recoiling pulley 228 provided on the flywheel on a side thereof opposite the mounting of arm 204 and pulley 224. A relatively lightweight extendible spring 229 connects an end 231 of cord 226 to housing 216 at mounting bracket 232. Acceleration of the flywheel 202 by pneumatic assembly 201, arm 217, cord 221 and pulley 224 simultaneously results in the winding of recoiling cord 226 on pulley 228 against the force associated with the extension or elongation of spring 229. When the flywheel 202 and eccentric camming pin 203 rotate into engagement with and actuate tensioning arm 204, the energy in the flywheel is dissipated, its motion stops and the recoiling force provided by spring 229 returns the flywheel and pin 203 to its initial position of rotation in preparation of the next ball ejectment cycle.

It will be observed that the energy used in tensioning the flexible elongate belt is derived in both the embodiments of FIGS. 1 through 6 and FIG. 9 from a pressurized air source, which may be provided by a refillable air tank as discussed above. In the embodiment of FIGS. 1 through 6, the air pressure energy is temporarily stored in the form of the potential energy of the flexed bow spring member 42 whereas in FIG. 9 the energy is temporarily stored in the form of the kinetic energy associated with the rotating flywheel 202. In both cases, the temporary energy storage mechanism serves to permit the application of a burst or impulse of force to and for actuating the tensioning arm.

It has been found that the energy applied to the tensioning arm is substantially, completely exhausted or absorbed by the energy required for propelling the ball into its trajectory. In other words, the energy associated with the momentum and spin of the tennis ball, minus any losses due to ball distortion during acceleration, is only slightly less than the total amount of energy applied to the tensioning arm to drive it from its unactuated to its actuated condition. Once the tennis ball has been discharged from the apparatus, there is little if any energy left in the device to be dissipated in the form of vibration and noise, thus resulting in a quieter, longer lasting unit.

The theoretical reason underlying this very efficient transfer of energy from the means used for tensioning the belt to the momentum imparted to the ball, may be explained by means of a mathematical analysis of the dynamics involved in tensioning the belt. In general, the tensioning of the belt from its initial slackened, curved or looped condition into the straightened, tensioned condition causes the belt at the ball-to-belt interface to be driven at a velocity which approaches infinity with respect to the differential tensioning displacement applied to the opposite belt ends. For this reason, the velocity or speed of the ball is theoretically unlimited and assumes a speed or momentum which is correlative to the amount of energy or force applied to tension the belt. This is more particularly illustrated with reference to FIG. 10, in which the geometrical analog of the ball propulsion method and apparatus is depicted on an $x$–$y$ graph, in which:

$l$ = One half of the belt length between the ball-to-belt interface and one end of the belt.

$a$ = The initial $x$ axis position of the ball-to-belt interface.

$a'$ = The $x$ axis position of the ball-to-belt interface after a lapse of time between the initial ball position and an intermediate point of ball acceleration prior to the belt assuming a straight condition.

$\theta_o$ = Initial angle that the upper section of the belt represented by length $l$ makes with reference to the $x$ axis.

$\theta$ = The angle corresponding to $\theta_o$ above after the ball-to-belt interface has reached position $a'$.

$b$ = The initial $y$ axis position of the end of the belt which is driven by the tensioning arm.

$b'$ = The position of the second end of the belt along the $y$ axis after the ball-to-belt interface has reached $a'$ on the $x$ axis.

$\Delta yb$ = The incremental change in the distance of the second end of the belt as it moves along the $y$ axis between $b$ and $b'$.

C = The initial placement of the second end of the belt along the $x$ axis.

H = The initial position of the second end of the belt along the $y$ axis.

With the foregoing geometrical relationships thus defined, the mathematical analysis of the belt tensioning mechanism may be demonstrated by the following equations:

$$l = \frac{H}{\sin \theta_o} = \sqrt{C^2 + H^2}$$

$$\Delta yb = l\sin\theta - H$$

$$\Delta Y_b = H\left(\frac{\sin \theta}{\sin \theta_o} - 1\right)$$

$$Xa = C - l\cos\theta$$

$$X_a = C - H\frac{\cos \theta}{\sin \theta_o}$$

$$\frac{\delta X_a}{\delta \theta} = + \frac{H}{\sin \theta_o} \sin \theta + O$$

$$\frac{\delta \Delta Y_b}{\delta \theta} - = H\frac{\cos \theta}{\sin \theta_o}$$

$$\frac{\delta X_a}{\delta \Delta y_b} = \frac{H\sin\theta}{\sin \theta_o} \cdot \frac{\sin \theta_o}{H \cos \theta}$$

$$\frac{\delta X_a}{\delta \Delta Y_b} = + \frac{\sin \theta}{\cos \theta} = + \tan \theta$$

As the belt is driven to a straight tensioned condition, the angle $\theta$ approaches 90° and the tangent of $\theta$ approaches infinity. From this it is seen that a very small velocity in the differential tensioning displacement applied at the second end of the belt as shown in FIG. 10 produces an extremely large forward speed along the $x$ axis because of the relationship:

$$\frac{\delta X_a/\delta \text{ time}}{\delta \Delta Y_a/\delta \text{ time}} \longrightarrow \infty$$

This fact allows the game ball to theoretically absorb all of the energy applied to the tensioning mechanism which drives the longitudinally spaced end portions of the belt from relatively proximate positions to distal or belt tightened positions. There are, however, certain small, unavoidable energy losses in the machine due to friction and seal losses associated with the operation of the pneumatic cylinder assemblies, air line losses and losses associated with the distortion of the ball due to the tremendous acceleration forces imposed thereon as it is driven by the belt.

While only a limited number of embodiments of the present invention have been disclosed herein, it will be readily apparent to persons skilled in the art that numerous changes and modifications may be made thereto without departing from the spirit of the invention. For example, the method and apparatus of the present invention has been illustrated in the foregoing embodiments by orienting the ball propelling belt for flexure in a plane which is generally vertical with respect to the court and applying the differential tensioning force to the upper belt end. It will be observed, that the belt may be mounted within a housing similar to housing 14 at any desired angular orientation with respect to the court surface so as to drive the ball in a desired trajectory. Moreover, the orientation of the plane of flexure of the belt may be combined with a tensioning means for displacing either end of the belt, or both ends of the belt with differential displacement relative to the initial ball position to propel the ball with bottom spin, side spin, top spin and in general any axis of spin desired.

Furthermore, the embodiments of the invention disclosed herein provide for operating the belt tensioning mechanism by means of a pressurized air tank or other source of pressurized air. Although the portable air pressure tank has been found to be a preferable energy source for the device for the reasons hereinabove discussed, it will be appreciated that other energy sources may be utilized including gasoline engines, electric motors or other power sources suitably coupled to the belt tensioning means. For example, a continuously rotating gasoline engine or electric motor drive may be selectively coupled by a solenoid operated clutch mechanism to a tensioning arm to cause the arm to be periodically driven to its actuated, belt tensioning position.

Accordingly, the foregoing disclosure and description thereof are for illustrative purposes only and do not in any way limit the invention which is defined only by the following claims.

What is claimed is:

1. An apparatus for propelling tennis balls with spin so as to simulate the action of a tennis ball delivered by a spin imparting tennis racket stroke, comprising in combination:

support means for providing a support;

an elongate, pliable, ball propelling member having longitudinally spaced apart portions and defining a ball engaging and propelling surface thereon lying between said portions;

member tensioning means mounted on said support means and connected to said portions of said member for differentially displacing said member portions relative to said support means to flex said member between a slackened, looped condition and a tensioned, generally straightened condition and simultaneously cause longitudinal displacement of said surface of said member relative to said support means;

control means operatively associated with said member tensioning means for operating said tensioning means to repetitively displace said member portions to repetitively flex said member;

ball feeding means adapted for receiving a plurality of tennis balls for successively feeding the balls one at a time to said surface of said member each time said member is disposed in said slackened, looped condition; and said ball engaging and propelling surface of said member being selected to effect frictional engagement with the exterior surface of each tennis ball when fed into contact therewith so as to impart spin to such tennis ball in reaction to said longitudinal displacement of said surface of said member as said member simultaneously propels the ball by reason of the flexure of said member toward said tensioned, straightened condition.

2. An apparatus for propelling balls, comprising:

support means for providing a support;

an elongate, pliable, ball propelling member having longitudinally spaced apart portions;

member tensioning means connected to said member portions and being movably disposed on said support means for differentially displacing said member portions with respect to said support means to flex said member between a slackened, looped condition and a tensioned, generally straightened condition; and said member tensioning means including an elongate tensioning arm connected to one of said member portions and being pivotally mounted about an axis spaced apart from said connection to said one of said member portions, means connecting the other of said member portions to said support means, and means for rotating said arm about said axis.

3. The apparatus as claimed in claim 2, wherein said means for differentially displacing said member portions further includes pneumatic power means for providing a source of pneumatic power, and releasable energy storage means operatively connected between said pneumatic power means and said arm for converting power produced by said pneumatic means into stored energy and releasing said energy to and for rotating said arm.

4. The apparatus as claimed in claim 3, wherein said energy storage means comprises a spring.

5. The apparatus as claimed in claim 3, wherein said energy storage means comprises a flywheel.

6. An apparatus for propelling balls, comprising:

support means for providing a support;

an elongate, pliable, ball propelling member having longitudinally spaced apart portions;

member tensioning means connected to said member portions and being movably disposed on said support means for differentially displacing said member portions with respect to said support means to flex said member between a slackened, looped condition and a tensioned, generally straightened condition; and said tensioning means including a pneumatic cylinder and piston assembly means for receiving air pressure from a source thereof to displace said member portions from said slackened, looped condition to said tensioned, straightened condition for propelling a ball and to displace said member portions from said tensioned, straightened condition back to said slackened, looped condition.

7. An apparatus for propelling game balls comprising:

support means for providing a support;

an elongate pliable member having first and second ends movable between a relatively proximate relationship in which said member assumes a slackened, looped condition and a relatively distal relationship in which said member assumes a tensioned, generally straightened condition;

ball receiving and positioning means disposed on said support means adjacent a ball engaging and propelling surface of said member wherein said surface faces generally forwardly toward a predetermined direction of ball propulsion;

member tensioning means disposed on said support means and connected to said member at said first and second ends, said tensioning means being operative to differentially displace said member ends with respect to said ball receiving and positioning means between said relatively proximate and relatively distal relationships, so that said member is caused to assume said tensioned, straightened condition for propelling and simultaneously spinning a game ball; and wherein said member tensioning means includes mounting bracket means connecting said first end of said member to said support means, said mounting backet means including resiliently yieldable means for foreshortening said member when in said slackened, looped condition and yielding so as to permit lengthening of said member when it is in said tensioned, straightened condition, whereby said mounting bracket means aids said member in imparting spin to a ball.

8. The apparatus as claimed in claim 7, wherein said member tensioning means includes an elongate tensioning arm connected adjacent one of its ends to said second end of said member, said arm being pivotally mounted on said support means about an axis that is spaced apart from and extends substantially transversely to said member when said member is in its tensioned, straightened condition, and said member tensioning means further includes means for pivoting said arm about said axis to displace said member ends between said proximate and distal relationship.

9. The apparatus as claimed in claim 8, wherein said means for pivoting said arm includes spring means connected to said arm and being resiliently deformable between an unloaded condition and a loaded condition, said spring means being operable to recoil from said loaded condition to said unloaded condition pivoting said arm to displace said member ends from said relatively proximate relationship to said relatively distal relationship, and means for deforming said spring means from said unloaded condition to said loaded condition.

10. The apparatus as claimed in claim 9, wherein said means for deforming said spring means includes a pneumatic cylinder and piston assembly.

11. The apparatus as claimed in claim 10, wherein said member tensioning means further includes pneumatically operated latch means disposed between said support means and said arm and having a latched condition and a release condition, said latch means in its latched condition being operative to maintain said arm in a first pivotal position in which said member ends are in said proximate relationship during deformation of said spring means from said unloaded condition and to said loaded condition, and said latch means being operative in its release condition to release said arm to be pivoted by recoil of said spring means from said loaded condition to said unloaded condition.

12. A method of propelling tennis balls in a way that simulates the action of a tennis ball delivered with spin by a tennis racket, comprising in combination:

a first step of automatically disposing longitudinally spaced apart portions of an elongate pliable member in relatively proximate relationship to cause said member to assume a slackened, looped condition between said portions;

a second step of automatically feeding a tennis ball into a launching position adjacent an inwardly curved surface of said member lying along said member between said portions when said member is in said slackened, looped condition;

a third step of automatically differentially displacing said portions of said member relative to said launching position of said tennis ball to move said portions toward a relatively distal relationship that effects both a tensioning of said member and longitudinal displacement of said surface of said member relatively to said launching position of said tennis ball, said surface of said member being selected to frictionally coact with the exterior surface of said tennis ball such that said tennis ball is both propelled outwardly by said tensioning of said member and is simultaneously spun by the combined effects of frictional coaction between the surface of said member and the ball and said longitudinal displacement of said surface of said member; and automatically repeating the first, second and third steps, whereby a series of practice tennis balls are propelled with spin.

13. A method of propelling balls comprising:

disposing longitudinally spaced apart portions of an elongate pliable member in an initial relatively proximate relationship to cause said member to assume a slackened, looped condition between said portions;

disposing a ball in a launching position adjacent an inwardly curved surface of said member lying between said portions when said member is in said slackened, looped condition;

displacing said member portions differentially with respect to said launching position of said ball and toward a relatively distal relationship to flex said member to a tensioned, generally straightened condition propelling said ball outwardly from said surface and simultaneously spinning said ball; and wherein said step of displacing said member portions includes the sub-steps of:

producing a pneumatically powered force;

storing said pneumatically powered force in an energy storage means operatively connected to said member;

releasing an impulse of energy from said energy storage means; and applying said impulse of energy from said storage means to said member to effect said step of displacing said member portions.

14. The method as claimed in claim 13, wherein said step of applying said impulse of energy to said member includes the sub-steps of:

connecting one of said member portions to a support and connecting the other of said member portions to a rotatably mounted tensioning arm, and rotating said tensioning arm in response to said impulse of energy from said storage means to displace said member portion connected to said arm away from said member portion connected to said support means.

15. The method as claimed in claim 13, wherein said sub-steps of storing, releasing and applying include resiliently deforming a spring to a loaded condition and releasing said spring to recoil to an unloaded condition, and connecting said spring to said member.

16. The method as claimed in claim 13, wherein said sub-steps of storing, releasing and applying include storing said energy as inertia in a rotating flywheel and releasing said energy by coupling the rotational energy in said flywheel to said member.

* * * * *